US005269534A

United States Patent [19]

Saunders et al.

[11] Patent Number: 5,269,534

[45] Date of Patent: Dec. 14, 1993

[54] ADJUSTABLE WEIGHT ARROW POINT

[75] Inventors: Charles A. Saunders, Columbus; Benedict M. Paczosa, Sr., Duncan, both of Nebr.

[73] Assignee: Saunders Archery Co., Columbus, Nebr.

[21] Appl. No.: 991,277

[22] Filed: Dec. 16, 1992

[51] Int. Cl.[5] ..... F42B 6/08

[52] U.S. Cl. ..... 273/419; 403/343

[58] Field of Search ..... 273/416; 419, 420, 421, 273/422; 403/343

[56] References Cited

U.S. PATENT DOCUMENTS

| | | | |
|---|---|---|---|
| 3,876,319 | 4/1975 | Meyer | 403/343 |
| 3,984,192 | 10/1976 | Wanner et al. | 403/343 |
| 4,050,696 | 9/1977 | Troncoso, Jr. | 273/420 |
| 4,533,146 | 8/1985 | Schaar | 273/422 |
| 4,944,520 | 7/1990 | Fingerson et al. | 273/419 |

FOREIGN PATENT DOCUMENTS

| | | | |
|---|---|---|---|
| 520857 | 5/1940 | United Kingdom | 273/420 |

OTHER PUBLICATIONS

Bow & Arrow Hunting, Oct. 1990, Turbo SS Ad.

*Primary Examiner*—Paul E. Shapiro

*Attorney, Agent, or Firm*—Michael G. Berkman

[57] ABSTRACT

An arrow point with a selectably-adjustable, incrementally-stepped array of weight-regulating elements. The weighting elements are demarked lineal component segments of an elongate rod or bar which is deeply grooved radially at incremental, lineally-spaced positions along its length. The rod is threaded at its forward end for coupling engagement with a threaded neck portion of the arrow point. Prior to sleevedly assembling the arrow point with the shaft of the arrow, the segmental rod is severed at a particular pre-set groove to leave a selectable number of weight segments attached. The latter remain as a secured, weight-adjusting core component of the arrow point assembly. An O-ring seated in a diminutive, outwardly-opening annular groove formed in a sector of the rod forwardly of the segmental array bears upon an enveloping inner wall of the body of the point assembly to stabilize and to lock the rod frictionally within the core of the arrow point.

10 Claims, 1 Drawing Sheet 3
3
20
24
26
34
58
24
64
86
82
86
82
80
100
92
90
108
98
30
70
30
58
68
54
34
40
46
42
48
52
36
26
82
24
30
70
100
102
104
90
96
68
92
60
58
50
54
40
48
52
34
26

ADJUSTABLE WEIGHT ARROW POINT

BACKGROUND OF THE INVENTION

The present invention relates to an arrow point assembly for hunting and for archery target use. More particularly, the invention is directed to an arrow point provided with adjustable weight features and capabilities.

Devices and various mechanical arrangements by which one may add to and adjust the total weight of an arrow point within desired overall total weight ranges are known in the art. In one such system one or more stub screws of the same or of different weights are threadedly inserted into a hollow threaded chamber of a point to be weighted. A special tool is required to seat the threaded inserts. An alternative prior art technique is adhesively to secure weighting elements within the body of the arrow point. In yet other arrangements the arrow point is fitted with a long, rearwardly-extending shaft which is slidably received within to extend a substantial distance into the hollow arrow shaft. A desired number of prescored sections of the shaft is broken off to effect weight adjustment. The weight of the arrow shaft itself, and not the arrow point, is what is varied on the system described.

The aim of the present invention is to obviate some of the short-comings and inadequacies of the prior art arrow point weighting systems and to provide simple and reliable apparatus and techniques for establishing, selectively, preferred arrow point weights both for hunting and for target use.

SUMMARY OF THE INVENTION

The apparatus of the present invention is characterized in that it enables one to adjust the weight of an arrow point simple, quickly, incrementally and accurately over a broad range of selectable total weights, and without the use of special tools.

In a preferred embodiment of the invention the weight-adjusting device takes the form of a relatively short bar which extends into the body of the arrow point and is threadedly connected at the rear of the tip portion of the arrow point assembly. The bar also firmly locks the casing-like body or coupler section of the arrow point assembly to the tip section of the arrow point.

It is an important feature of the invention that the bar is deeply grooved radially at lineally spaced positions along its linear expanse to delineate an array of incremental weight sections.

A related feature of the invention is that the weight bar is frangible, selectively, at each groove to separate any desired number of weight segments therefrom, thereby to achieve an arrow point weight addition correlated with the remaining portion of the rod including the segmental components remaining integrally affixed thereto.

In preferred embodiments of the invention the groove-delineated weight segments may be any selectable values, but are preferrably 10 grains each or 5 grains each, or 15 grains each.

It is a feature of the present invention that one size of the incrementally-grooved, segmented weight-adjusting bar fits all aluminum arrow shafts.

A related feature of the invention is that it facilitates establishing the same arrow point weights in target points and in broadheads used in hunting.

Yet another advantage of the versatile weight bar is that it simplifies meeting those requirements which must be met in tournament competition.

A general utilitarian feature of the present invention is that it permits varying the weight of an arrow point over a wide range of total weights, in controlled and readily reproducible increments.

In a preferred embodiment of the invention the weight rod is non-circular, for example, hexagonal in cross section.

It is a feature of one embodiment of the invention that the forwardly extending end of the weight rod is drilled axially and tapped to couple threadedly with a threaded stub shaft projecting rearwardly of the point component of the arrow point assembly.

A related feature of the variable weight arrow point of the invention is the provision in the coupling component of the arrow point of a radially inwardly directed shoulder or flange against which a forward end face of the weight rod presses to lock the coupler in place when the point is threadedly connected to the weight rod.

Yet another important feature of the weight-adjusting rod of the invention is the provision of an O-ring seated in an annular groove in a lineal zone of the rod forwardly of the incremental weight segments and serving frictionally to engage an inner bounding, generally cylindrical wall of the arrow shaft coupler.

In a preferred embodiment of the invention the weight rod is formed at its forwardly presented end with a cylindrical neck section which nests contiguously within a bushing-like collar formed in a forward zone of the coupler element rearwardly of a shoulder against which a forward end face of the weight rod abuts.

Other and further objects, features and advantages of the invention will be evident from a reading of the detailed description of the invention considered in conjunction with the drawings.

DETAILED DESCRIPTION OF ILLUSTRATED EMBODIMENT

Figures 1, 2, 3:
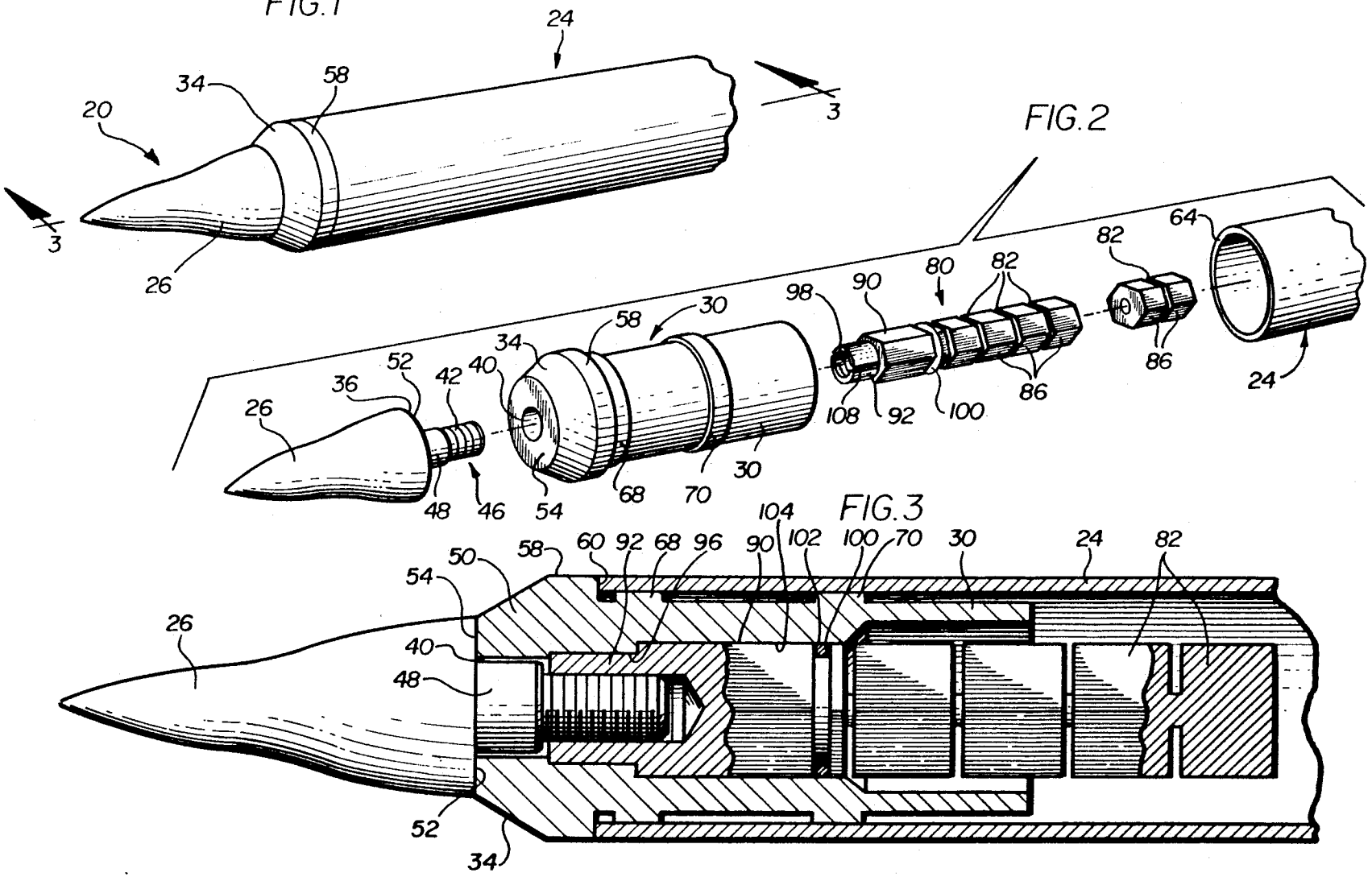
FIG. 1 is a fragmentary, perspective view of an arrow-shaft-mounted arrow point embodying features of the present invention.
FIG. 2 is exploded perspective view showing the various components of an adjustable weight arrow point in accordance with the present invention and indicating schematically the manner of assembly and weight adjustment.
FIG. 3 is an enlarged cross-sectional view taken substantially on the lines 3—3 of FIG. 1 and showing the adjustable-weight arrow point of the assembly in a shaft-connected assembled mode.

The aims and objects of the present invention are achieved, in accordance with the practice of the present invention, by providing, in an arrow point assembly, the capability of simply and conveniently adjusting the weight of the arrow point to a desired selectable value along a range of total weight, incrementally. The invention is characterized in that the weight-adjusting or varying structure is a unitary bar or rod conveniently pre-marked or mechanically scored to delineate a series of incremental weight-contributing lineal sectors or segments of selectable, predetermined weight values. The weight rod is stabilized within the body or chamber-like core of the arrow point assembly. No special tools are required in achieving the desired final arrow point weight. Nor is any modification of the arrow shaft itself required.

Referring now to the drawings, and particularly to FIGS. 1 and 2, there is shown, for illustrative purposes and not in any limiting sense, a preferred embodiment of the adjustable weight arrow point of the invention incorporating the features thereof.

In the specific example of the invention depicted, an arrow point assembly 20 is shown as coupled to a tubular arrow shaft 24. As seen most clearly in FIG. 2, the arrow point assembly 20 includes a tapered and contoured lead point 26, and a hollow, arrow-coupling body section 30 of generally cylindrical configuration. The body section 30 of the arrow point assembly 20 is integrally formed at its forwardly-presented end with a frustoconical sector 34 constricted in a forward direction and terminating in a forward end having an outer diameter corresponding to the outer diameter of a rear extremity 36 of the tapered arrow point 26, The frustoconical sector 34 is formed with a restricted through axial bore 40 through which a threaded 42 stub shaft 46 of the point 26 is received. The shaft 36 includes a neck portion 48 which is matingly received within the bore 40 of a collar 50 of the sector 34 when the facing surfaces 52 of the point 26 and 54 of the sector 34 are brought into contiguous abutting contact (FIG. 3). The bore 40 is preferably tapered or constricted.

The frustoconical section 34 is integrally formed with and terminates in a cylindrical segment 58 defining a shoulder 60 against which the end 64 of the tubular arrow shaft 24 seats. As shown in FIGS. 2 and 3 the arrow-coupling body 30 is formed with a pair of linearly-spaced ring-like bands 68 and 70 dimensioned diametrically to constitute inner supports and stabilizers for the arrow shaft 24 sleeved thereover (FIG. 3).

In accordance with the practice of the present invention, the weight of the arrow point assembly 20 is conveniently, accurately, and reproducibly adjusted through the use of selectable incremental weight elements. As shown in FIG. 3, the weight-regulating device of the invention takes the form of a bar or rod 80 which is radially grooved or slotted 82 along its longitudinal expanse to define an array of lineally-spaced, incremental weight segments 86. In the example pictured, six such weight elements 86 are shown, with two having been severed from the end of the rod 80 schematically to indicate adjustment of the rod weight by cutting off a selectable number of discrete elements. Severance or separation of any desired number of elements is conveniently effected by sawing or otherwise completing the cut through the preformed slots 82. In the specific embodiment of the weight rod 80 shown, the rod is noncircular, specifically hexagonal in cross section. Accordingly, the rod may conveniently be gripped at two adjacent segments and twisted to achieve a shearing separation.

Any preferred weight increments may be used. In the specific example illustrated, each segment weighs about 10 grains, and the overall weight of the entire rod 80 is about 145 grains. Thus the minimum rod weight in the example depicted is about 85 grains (with all six segments severed).

At its forwardly directed end, the weight rod 80 has an unmodified body section 90 integrally joined to a cylindrical neck 92 sized to sleeve within the bushing-like mating collar 96 in the coupler section 30 of the point assembly 20. The neck 92 is drilled and tapped 98 axially for matingly engaging the threads 42 of the stub shaft 46 of the arrow point 26. The structure described secures the point 26, the coupler section 30 and the weight bar 80 together as a stable, composite entity.

In the specific preferred embodiment of the invention illustrated, stability and security of the assembly are enhanced by the expedient of an O-ring 100 seated in a radially outwardly opening annular groove 102 encircling the body section 90 of the weight rod 80. Upon assembly of the weighted arrow point assembly, the O-ring 100 is stressingly and resiliently entrapped between the weight bar 88 and the encircling inner wall 104 of the coupler 30 physically to stabilize the rod 88 and frictionally to prevent inadvertent axial displacement.

The bounding wall of the neck, 92 of the rod 80 is tapered (to enlarge rearwardly) and is formed with lineally-extending slits 108 so as to ensure a snug and tensioned engagement of the neck 92 within the bore 40 as the threads 42 of the stub shaft 46 engage the threads 98 of the neck 92 to draw the neck into the tapered bore 40 of the body section 30 of the assembly 20.

What is claimed is:

1. An adjustable-weight arrow point comprising an arrow point assembly including a point element, an arrow shaft coupling section defining a hollow core having an inner wall, and weighting means for securement within said arrow point assembly for incorporating selectable additional weight into said assembly, said weighting means comprising an elongate bar, said bar being formed with a plurality of lineally-spaced, radial grooves demarking a lineal, coaxial array of incremental weight segments, said weighting means projecting interiorly of said coupling means coaxially therewith, and extending rearwardly of said coupling section, said point element being formed at a rearward end thereof with thread means for threaded engagement with said elongate bar, coaxially therewith, said bar being formed at its forward end with thread means for coupling engagement with said thread means of said point element, said coupling section being formed with radially inwardly directed collar means for abutting said bar sleevedly projecting therewithin, interengaging threads of said point element and said elongated bar comprising means for lockingly securing said coupling section fixed with said point element and for establishing said rod, said coupling section, and said point element as a stable composite assembly, and said elongate bar being severable at any of selectable said grooves to leave a selectable number of said incremental weight segments within said arrow point assembly to establish said bar as an arrow-point-housed weight controlling component thereof.

2. The arrow point assembly as set forth in claim 11 and further comprising O-ring seated in an annular groove formed in and encircling said elongate bar forwardly of said segments thereof for stressingly bearing upon said coupling section of said arrow point assembly against an enveloping said inner wall thereof to stabilize and to lock said bar frictionally within said arrow point assembly.

3. The weighting means as set forth in claim 1 wherein said incremental weight segments are each 10 grains in weight, wherein the overall weight of said rod is 145 grains and wherein said rod has a weight of 85 grains, with six incremental segments severed therefrom.

4. The arrow point assembly as set forth in claim 1 wherein said incremental weight segments are 15 grains each in weight.

5. The weighting means as set forth in claim 1 wherein said elongate rod is non-circular in transverse section.

6. The structure as set forth in claim 5 wherein said bar is hexagonal in transverse section.

7. The structure as set forth in claim 1 wherein said point element comprises an arrow point terminating at a rearward end in an externally threaded stub shaft, and wherein said bar is formed at a forward end thereof with an axial bore threaded for mating with said threaded stub shaft, coaxially therewith.

8. The structure as set forth in claim 7 wherein said coupling section is formed with a rearwardly-flaring, tapered, axial bore at a forward end zone thereof, and wherein said bar defines a neck at a forward end thereof, said neck of said bar being tapered on its bounding outer surface for matingly engaging within said tapered axial bore formed in the forward end zone of said coupling section.

9. The structure as set forth in claim 8 further comprising slit means formed in said neck of said bar, lineally along said, neck, for enhancing positive engagement of said neck of said bar within said tapered bore in said coupling section of said arrow point assembly.

10. The structure as set forth in claim 11, wherein said coupling section of said arrow point assembly is formed interiorly thereof at a forward zone thereof with a rearwardly presented annular shoulder for abutment of a forward end face of said bar thereagainst, and wherein said coupling section includes a bushing-like collar for receiving a forwardly directed annular neck-like projection of said rod therewithin in contiguous nesting relation therewith.

* * * * *